US008402563B1

(12) United States Patent
Kirby

(10) Patent No.: US 8,402,563 B1
(45) **Date of Patent: *Mar. 26, 2013**

(54) CAMOUFLAGE FOR HUNTER OR SOLDIER OR THE LIKE

(76) Inventor: Richard C. Kirby, Orchard Park, NY (US)

( * ) Notice: Subject to any disclaimer, the term of this patent is extended or adjusted under 35 U.S.C. 154(b) by 0 days.

This patent is subject to a terminal disclaimer.

(21) Appl. No.: 13/240,214

(22) Filed: Sep. 22, 2011

Related U.S. Application Data

(62) Division of application No. 12/322,435, filed on Feb. 2, 2009, now Pat. No. 8,042,196.

(60) Provisional application No. 61/063,243, filed on Jan. 31, 2008.

(51) Int. Cl.

| | |
|---|---|
| ***F41H 3/02*** | (2006.01) |
| ***A41D 3/08*** | (2006.01) |
| ***A41D 1/04*** | (2006.01) |
| *F41H 3/00* | (2006.01) |

(52) U.S. Cl. ..... 2/129; 2/69; 2/69.5; 2/84; 2/88; 2/102

(58) Field of Classification Search ..... 2/132, 255, 2/256, 257, 258, 265, 266, 88, 95, 102
See application file for complete search history.

(56) References Cited

U.S. PATENT DOCUMENTS

| | | | | |
|---|---|---|---|---|
| 4,669,127 | A * | 6/1987 | Swanson | 2/46 |
| 4,865,900 | A * | 9/1989 | Shannon et al. | 428/195.1 |
| 5,025,507 | A * | 6/1991 | Kirby | 2/206 |
| 5,088,116 | A * | 2/1992 | Gould | 2/82 |
| 5,091,996 | A * | 3/1992 | Kirby | 2/206 |
| 5,524,956 | A * | 6/1996 | Moore | 297/4 |
| 5,673,836 | A * | 10/1997 | Bush | 224/576 |
| 5,695,835 | A * | 12/1997 | Weber et al. | 428/17 |
| 5,920,903 | A * | 7/1999 | Koehntop et al. | 2/69 |
| 5,956,765 | A * | 9/1999 | Chin | 2/69 |
| 6,010,183 | A * | 1/2000 | Perkins | 297/4 |
| 6,035,439 | A * | 3/2000 | Chin | 2/67 |
| 6,499,141 | B1 * | 12/2002 | Egnew | 2/69 |
| 6,658,666 | B2 * | 12/2003 | Schweer | 2/94 |
| 6,668,381 | B2 * | 12/2003 | Tarrell | 2/69 |
| 6,675,394 | B2 * | 1/2004 | Egnew | 2/227 |
| 6,698,026 | B2 * | 3/2004 | Schweer | 2/94 |
| 6,769,442 | B2 * | 8/2004 | Johnson | 135/96 |
| 6,892,395 | B2 * | 5/2005 | Schweer | 2/94 |
| 6,910,223 | B2 * | 6/2005 | Egnew | 2/69 |
| 8,042,196 | B1 * | 10/2011 | Kirby | 2/129 |
| 2002/0113103 | A1 * | 8/2002 | O' Hare | 224/155 |
| 2003/0084498 | A1 * | 5/2003 | Egnew | 2/94 |
| 2003/0168280 | A1 * | 9/2003 | Jones | 182/3 |
| 2003/0196245 | A1 * | 10/2003 | Schweer | 2/94 |
| 2003/0196246 | A1 * | 10/2003 | Schweer | 2/94 |
| 2004/0055068 | A1 * | 3/2004 | Egnew | 2/69 |
| 2004/0250331 | A1 * | 12/2004 | Bayer | 2/69 |
| 2005/0081272 | A1 * | 4/2005 | Shaklee | 2/4 |
| 2005/0160514 | A1 * | 7/2005 | Flaniken | 2/84 |
| 2005/0189176 | A1 * | 9/2005 | DeMeyer et al. | 182/231 |
| 2006/0036304 | A1 * | 2/2006 | Cordani et al. | 607/108 |

(Continued)

*Primary Examiner* — Bobby Muromoto, Jr.
(74) *Attorney, Agent, or Firm* — James C. Simmons

(57) ABSTRACT

Camouflage apparel for a hunter or solder or the like comprising a cape or sheet composed of camouflage material. The cape may be separate or attached to a pouch or hood of camouflage material. The cape and hood may be separate or attached to a portion of a vest which extends across the back of the neck of the wearer thereof such that the cape is receivable in the hood for stowage and such that the cape may be removed from the hood to drape across the front of the wearer. The vest has a seat which is stowably securable to the rear of the vest by straps which are fastened by buckles which are manipulatable at locations in front of the vest.

14 Claims, 10 Drawing Sheets

U.S. PATENT DOCUMENTS

2006/0174391 A1* 8/2006 Shannon ..... 2/86
2007/0017001 A1* 1/2007 Wagner et al. ..... 2/102
2008/0122267 A1* 5/2008 Larson et al. ..... 297/4
2010/0175175 A1* 7/2010 Helwig ..... 2/456

* cited by examiner

CAMOUFLAGE FOR HUNTER OR SOLDIER OR THE LIKE

This application is a divisional of application Ser. No. 12/322,435, filed Feb. 2, 2009 now U.S. Pat. No. 8,042,196, and the priority of U.S. provisional application 61/063,243, filed Jan. 31, 2008, is hereby claimed. These prior applications are hereby incorporated herein by reference.

The present invention relates generally to material for camouflaging a hunter or soldier or the like while, for example, lying-in-wait. While the present invention will be discussed herein with reference to hunters, it should be recognized that it may be similarly applicable to soldiers or others wherein it is important to conceal one's position.

Various materials have been provided for camouflaging hunters as well as soldiers, including clothing having camouflage patterns. My U.S. Pat. Nos. 5,025,507 and 5,091,996, the disclosures of which are incorporated herein by reference, disclose a face mask made of camouflage material for concealing at least a portion of a hunter's face. The camouflage material is a nylon net material the outer surface of which bears a camouflage print or pattern intended to provide the appearance of a wooded environment. As stated therein, it is known that by concealing a hunter from the view of wild game, the likelihood that the game will advance into close proximity to the hunter, so that the hunter can obtain a desirable shot at the game, is substantially increased.

Rain gear has been provided wherein a rain coat is attached to a hood which also serves as a carrying pouch. A military poncho has been provided with a hole in the center of a heavy water-proof material for use as a raincoat covering both front and back and attached to a hood.

Various blinds in the form of tents made of camouflage material have been provided to the hunter in back-packs or carrying bags which may have shoulder straps. Examples thereof are found on pages 834 to 837 of Cabela's Special Limited Fall Edition catalog, vol. IV, of Hunting, Fishing, and Outdoor Gear, 2004. The camouflage material may be nylon netting onto which elongate strips of die-cut leaves are sewn along the longitudinal centerline thereof thereby allowing the leaves to realistically flutter. Black-out liners have also been provided to conceal the hunters' movements within the camouflage tents.

Camouflage tents undesirably are bulky, heavy, must include stakes for erecting thereof thereby adding to the weight, and present another major item which a hunter must strap on or carry.

It is accordingly an object of the present invention to provide camouflage gear for a hunter or soldier lying in wait which is light and non-bulky and can be easily carried with other gear.

In order to provide such light and non-bulky camouflage gear which can be easily carried, in accordance with the present invention, a cape made of camouflage material is attached or attachable to the hunter's or soldier's vest, or provided as a separate article attached or unattached to a carrying pouch, for draping over the hunter's or soldier's body for concealing or camouflaging thereof.

Also in accordance with the present invention, a pouch for containing the cape for carrying is formed of camouflage material and formed so that it can be worn as a hood to camouflage the face.

The above and other objects, features, and advantages of the present invention will be apparent in the following detailed description of the preferred embodiment(s) thereof when read in conjunction with the appended drawings wherein the same reference numerals depict the same or similar items throughout the several views.

DETAILED DESCRIPTION OF THE PREFERRED EMBODIMENT(S)

Figure 1:
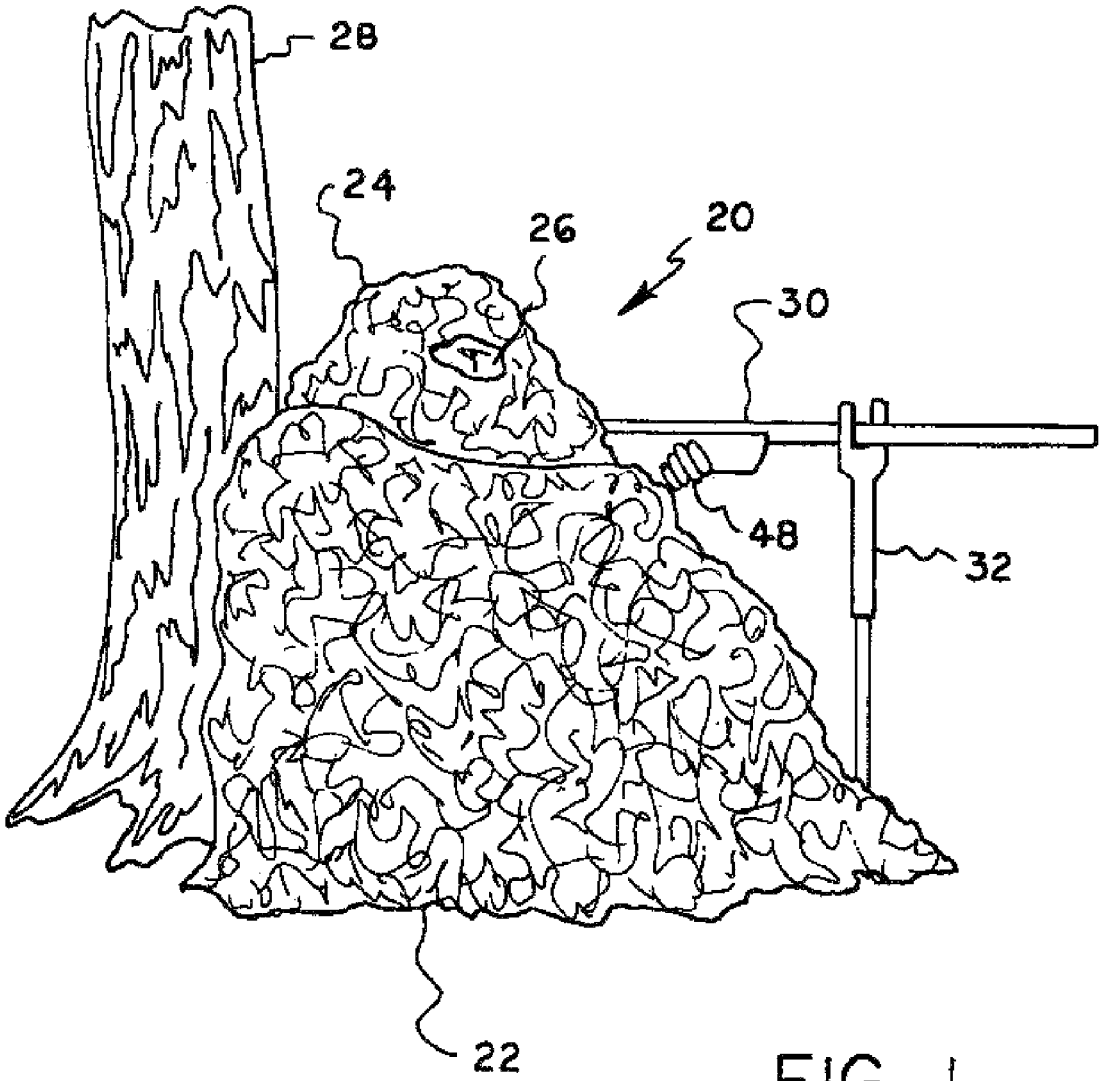
FIG. 1 is a perspective view of camouflage gear in accordance with the present invention in use.

Referring to FIG. 1, there is shown generally at 20 camouflage gear, including a cape 22 and a hood 24, generally covering a hunter 26 as the hunter 26 sits or kneels next to a tree trunk 28 lying in wait for wild game such as turkey. While the disclosure is directed herein to gear for hunting turkey, it should be understood that the present invention is also applicable to the hunting of deer and predators and other wild game as well as being applicable for soldiers and other persons for concealing their presence at their locations.

As used herein and in the claims, a "cape" is defined as a sleeveless garment in the form of a sheet of material which has structure (such as a hole or opening, discussed hereinafter, for receiving a person's head or such as fasteners or otherwise as suitable) which allows the garment to be secured at the neck of the person wearing the cape and which is sized sufficiently to allow it to hang downwardly from the neck over the front of the body of the person while in a sitting position. As defined herein, it should be understood that a cape may be worn as a separate item or attached to a hood and/or a vest or backpack.

Figure 2:
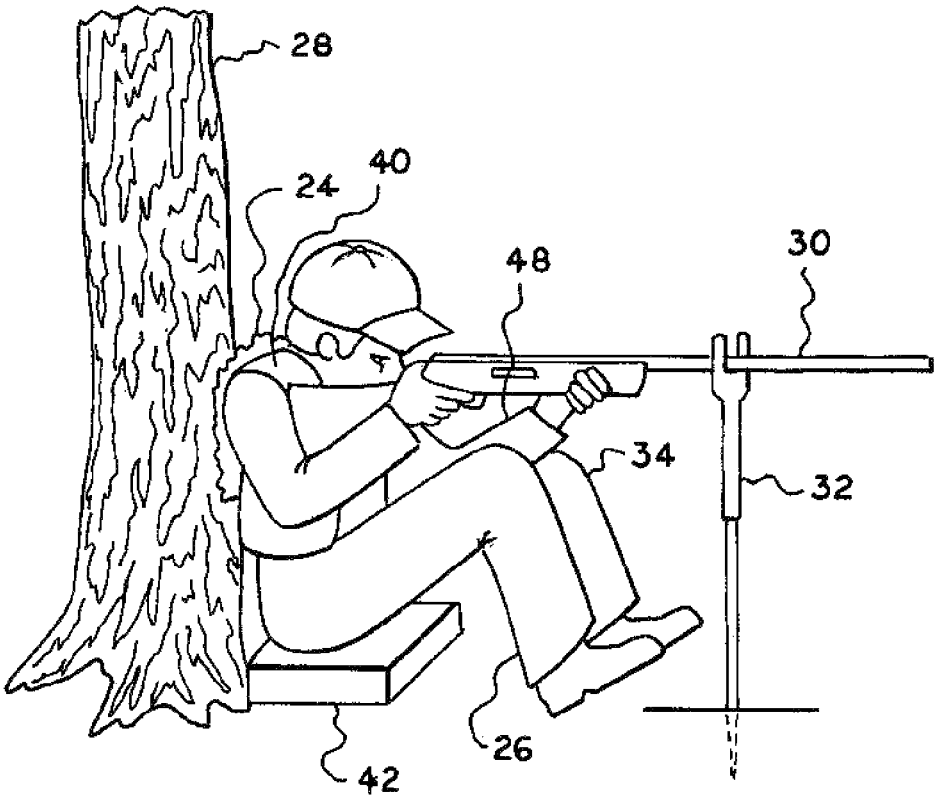
FIG. 2 is a perspective view of a hunter not using the camouflage gear.

FIG. 2 shows the hunter 26 wearing camouflage clothes 34 but not utilizing the cape and hood, which are instead shown being carried on the hunter's backpack 40 with the cape folded away into the hood 24, as will be discussed in greater detail hereinafter. The backpack is shown to have a cushion seat 42 for the hunter. It should be noted that, when the cape 22 and hood 24 are utilized as in FIG. 1, they give to the hunter more of the appearance of a small bush so as to more effectively prevent turkey from being scared away as they approach.

Figure 3:
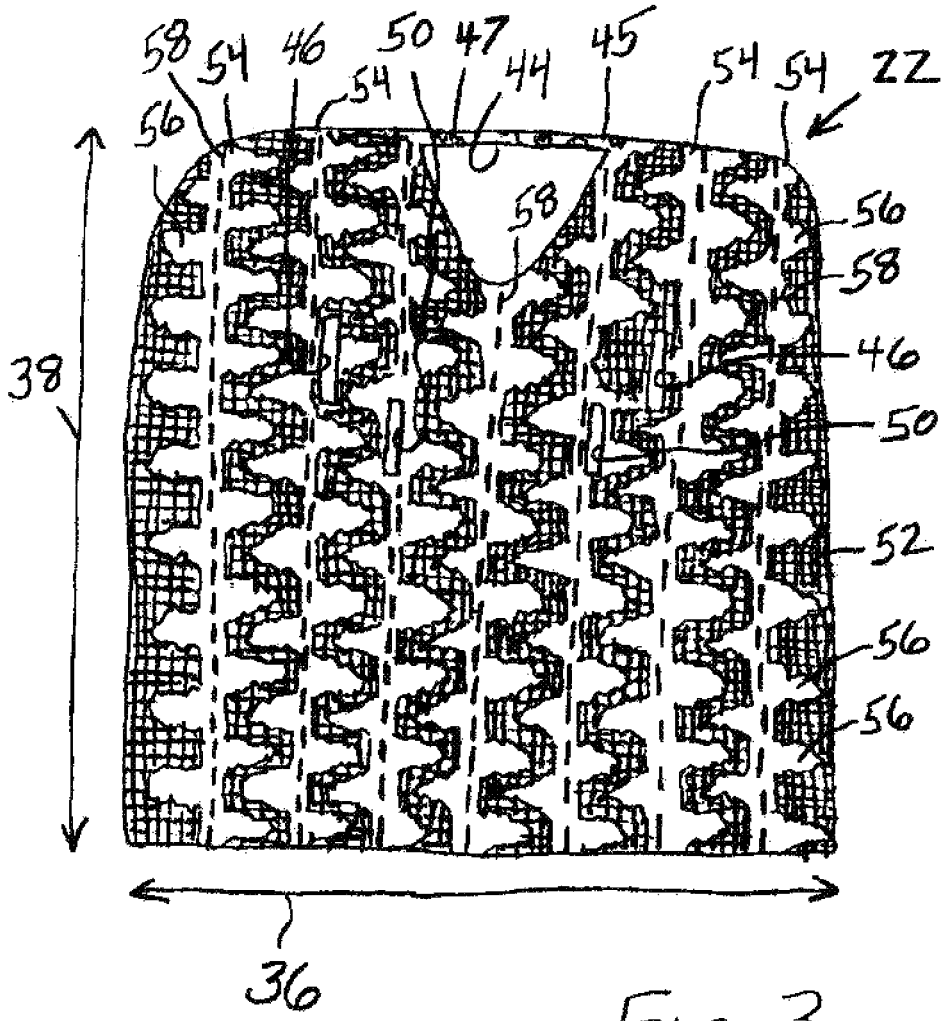
FIG. 3 is a plan view of a camouflage throw which embodies the present invention.

While the cape 22 will be discussed hereinafter in combination with the hood and/or vest, FIG. 3 shows the cape 22 as an unattached generally rectangular camouflage throw which is carried by the hunter in a carrying pouch or otherwise with the hunter's gear. The throw 22 should have a size large enough to effectively cover the hunter 26 yet not be so large as to result in greater weight and bulk. In order to achieve a suitable size, the throw 22 has a width, illustrated at 36, which is preferably between about 4 and 6 feet, and a length, illustrated at 38, which is preferably between about 5 and 7 feet. For example, the throw 22 may have a width 36 of about 5 feet and a length 38 of about 6 feet. An opening or hole, illustrated at 44, is provided centrally of and adjacent one of the narrower edges 45 and sized to receive the hunter's head, the opening 44 being, for example, about 10 inches in length along the edge and having a circumference of, for example, about 26 to 30 inches, for a more particular example, about 28 inches. Slits, illustrated at 46 (one on each side to accommodate both right and left handed hunters), are suitably sized and located to receive the gun 30. These slits 46 may, for example, be about 8 to 10 inches in length. Slits, illustrated at 50 (one on each side to accommodate both right and left handed hunters), are suitably sized and located to receive the hunter's forearm 48 for handling the gun 30. These slits 50 may, for example, be about 6 to 12 inches in length. Edges of the throw 22 are suitably hemmed.

By "adjacent," with respect to the location of an opening relative to a sheet or cape edge, is meant, for the purposes of this specification and the claims, that the opening is sufficiently close to an edge of the cape or sheet that, when a person's head is received in the opening, the sheet or cape drapes downwardly substantially only on one side (normally either front or back) of the person, unlike a poncho having a hole for the head in the middle (non-adjacent any edges) such that the poncho drapes downwardly on all sides of the person. Thus, the cape or sheet 22 is provided with the opening 44 sufficiently close to (adjacent) the upper edge 45 thereby defining a strip of material 47 between the opening 44 and the upper edge 45 so that it may be worn so that substantially all of the area of the cape 22 drapes downwardly across the front of the person (although it is understood that it may be worn, especially as a separate item, so that all of the area of the cape 22 drapes downwardly across the back of the person).

In order to minimize the weight and bulk of the throw 22 so that it is light-weight and compressible to reduce the storage space it takes up and well as being breathable, it is made of a suitable mesh or netting, illustrated at 52, such as, for example, nylon netting, onto which die-cut strips 54 of a pattern of leaves 56 are placed side-by-side and suitably sewed, as illustrated at 58, or otherwise suitably attached to the netting 52 along their longitudinal centerlines to thereby provide a three-dimensional effect of leaves fluttering in the wind when the wind blows for a more realistic camouflage effect. The strips 54 are laid so that the leaves 56 between adjacent strips interleave, as illustrated in FIG. 3, so as to reduce the visibility of the netting 52, which may also be camouflaged. The slits 46 and 50 are made in the netting 52. Such camouflage material from which the throw 22 is made is conventional. It should of course be understood that the throw 22 can be made of other suitable camouflage material.

For the purpose of this specification and the claims, the term "camouflage material" is defined as a material which has a pattern similar to the background of its intended use, such as a wooded or leafy pattern to merge with a wooded or leafy environment such as for hunting wild game, so as to conceal a person from being readily noticed.

The throw 22 is utilized by the hunter 26 slipping his or her head through the opening 44 (or otherwise suitably attaching the throw 22 at the neck to hang therefrom) so that the throw hangs downwardly across the hunter's front while sitting, inserting the gun 30 through a slit 50 and a forearm through a slit 46 to hold the gun 30 ready for shooting, and waiting, while thusly making-like-a-bush, for the approach of turkey. A suitable camouflage hood may be worn along with the utilization of the throw 22. If desired, a butt holder for the gun 30 may be suitably placed on the throw 22 and the gun 30 held with its butt against the butt holder.

Figure 4:
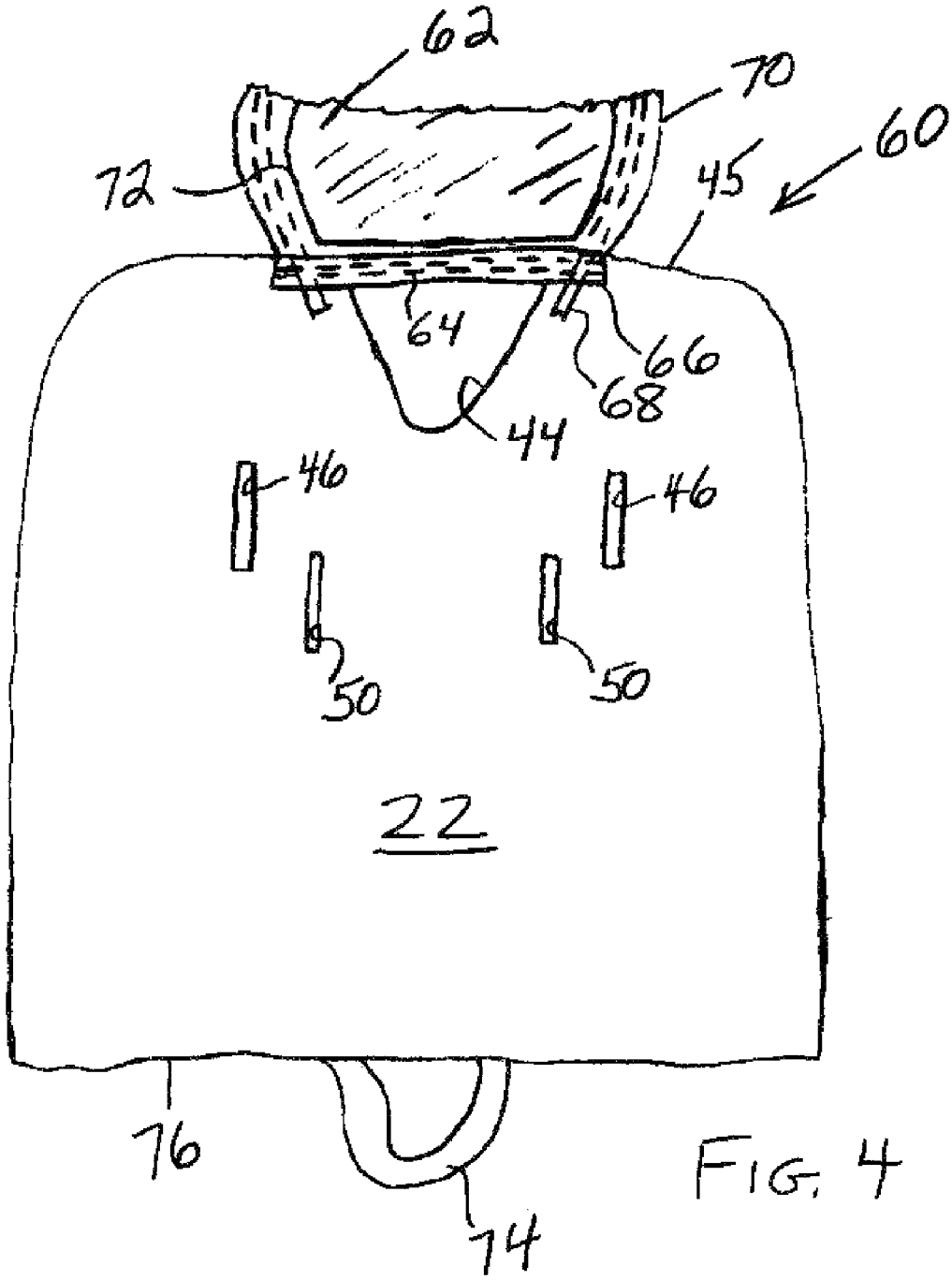
FIG. 4 is a partial plan view of the camouflage throw in combination with a camouflage hood/carrying case which embodies the present invention.

Referring to FIG. 4, there is shown generally at 60 a combination of the throw 22 with an attached camouflage hood 62 (partially shown), it being understood that the hood 62 is suitably shaped and sized, as is well known to those of ordinary skill in the art to which the present invention pertains, to be pulled onto and suitably cover the hunter's head. While for ease of illustration the camouflage effect is not shown in FIG. 4, it is also to be understood that the throw 22 is made to have a similar camouflage effect as illustrated in FIG. 3, and the hood 62 is suitably made of camouflage material.

A lower edge of the hood 62 is attached to the upper throw edge 45 by receiving the edge portion or strip of material 47 (FIG. 3) of the throw 22 and the edge portion of the hood 62 between the folds of a folded stiffening cloth member 66 (as seen in FIG. 4) and stitching, as illustrated by a double row of stitches 64, them to the folded stiffening cloth member 66.

The hood 62 may also serve as a carrying pouch. Thus, the pouch 62 may be opened and closed by use of an elastic cord 68 or other suitable cord received in a hollow tubular band 70 sewn along the perimetric edge 72 of the pouch opening. By pulling on both ends of the cord 68 and holding, as discussed hereinafter with respect to FIG. 11, the tubular member 70 is cinched up and the pouch 62 is accordingly closed, and by releasing both ends of the cord 68, the pouch 62 may be pulled open.

With the pouch 62 opened, the throw 22 is folded up or pushed into the pouch 62 and the pouch 62 thereafter closed by pulling on the draw cord ends and holding them in the pulled (cinched up) position.

For use of the throw 22 and hood 62, the draw cord ends are released and the hood 62 opened and the throw 22 pulled out. In order to aid in pulling out the throw 22, a suitable optional pull tab 74 is suitably sewed or otherwise attached to the throw lower or outer edge 76 (the edge opposite edge 45) centrally thereof. This allows the user to easily remove the throw 22 by finding the pull tab 74, which should be near the opening, and pulling thereon. The throw 22 is then placed over the hunter's body as discussed above with respect to FIG. 3 and the hood 62 suitably positioned on the hunter's head and held suitably in place, such as by cinching up on the draw string 68 and moving the grabbers 94 (described hereinafter) to lock the cinched-up position.

It should be understood that the hood 62 may otherwise be suitably attached to the throw 22, such as, for example, by a zipper or snaps or Velcro material, which would allow the hood to be detachable from the throw 22.

Referring to FIGS. 5 to 8, there is shown generally at 80 a conventional turkey hunter's vest to which the cape 22 and hood 62 are permanently or removably attached, as discussed hereinafter.

By the term "vest," as used herein and in the claims, is meant an upper body garment or backpack or other structure worn on the upper body.

The vest 80 includes a yoke 81 which comprises a portion 83 (having a forward edge 82) which extends about the back of the neck and a pair of suitably cushioned shoulder strap portions 88 which extend therefrom over the shoulders respectively, and the front lower ends of the shoulder straps 88 are suitably connected to respective straps 102 which are buckled to respective straps 104 by respective buckles 106, the straps 104 being in turn suitably connected to respective left and right front vest portions 108 respectively. Straps 112 attached to the lower end portions of the shoulder straps 88 are connected by buckle 114, and straps 116 attached to the vest portions 108, intermediate the heights thereof, are connected by buckle 118. The buckles 106, 114, and 118 are provided for changing size and tightening the vest 80 to the hunter 26. A backing member or body portion 110 of the vest 80 is suitably attached to and extends downwardly from the yoke neck portion 83 to engage the back of the hunter 26, and the backing member 110 is adjustably attachable to the front vest portions 108 by upper and lower straps 120 and 122 respectively and buckles 124 and 126 respectively.

Figure 7:
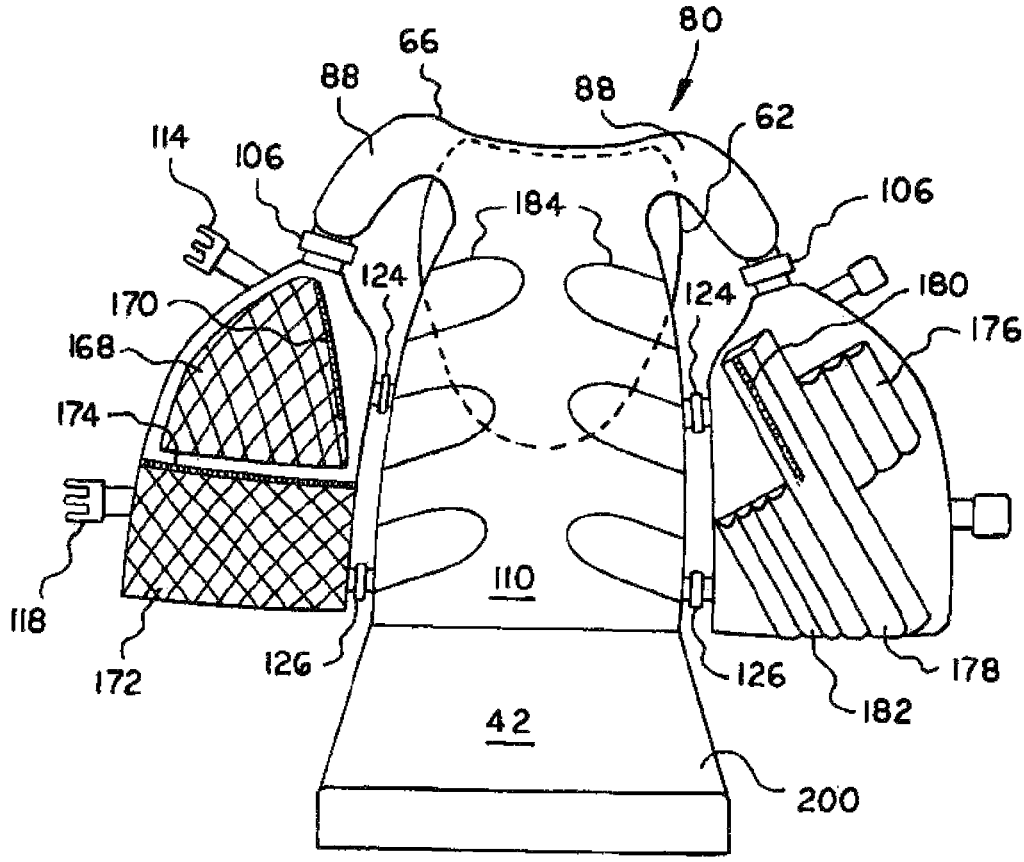

The vest 80 conventionally contains various items for hunting turkey. Thus, a clip 130 (illustrated in FIG. 5, not shown in FIG. 6) is sewed onto each of the shoulder straps 88 for holding a gun butt holder 132 on either shoulder strap for either left-handed or right-handed shooters. The right-side front vest portion 108 is shown to have, from top to bottom, a slanted box call pouch 134 (slanted for best position when seated—may be crushed if horizontal and may bind if vertical) opened and closed by a zipper 136, a pouch 138 opened and closed by a zipper 140 for holding a striker for a friction call, a friction call slanted pouch 142 opened and closed by a zipper 144 (positioned so that the call doesn't fall out when opened), and a storage or carrying pouch 146 with a zipper 148 for opening and closing it. The left-side front vest portion 108 is shown to have, from top to bottom, a flap 150 covering alligator clips 152 to hold wet mouth calls 154 to permit them to dry, a double-sewn (double layer of material for structure and water-proofness) flap assembly 156 covering rectangular/circular mouth call containers 158, an inside carrying or storage pouch 160 with an opening and closing zipper 162, and an outside carrying or storage pouch 164 with an opening and closing zipper 166. Referring to FIG. 7, the inner side of the right-side front vest portion 108 is shown to have, from top to bottom, an upper storage pouch 168 made of netted material and having an opening and closing zipper 170, and a lower storage pouch 172 made of netted material and having an opening and closing zipper 174. Continuing to refer to FIG. 7, the inner side of the left-side front vest portion 108 is shown to have, from top to bottom, storage pockets 176 for tube and like calls, a storage compartment 178 for shooting aids such as shooting aid 32 (which, as is conventional, is collapsible—two pieces—to be receivable therein) and having an opening and closing zipper 180, and a storage pouch 182. The inner side of the backing member 110 is suitably fitted with a series of left and right side vertically spaced comfort pads 184.

Figure 5:
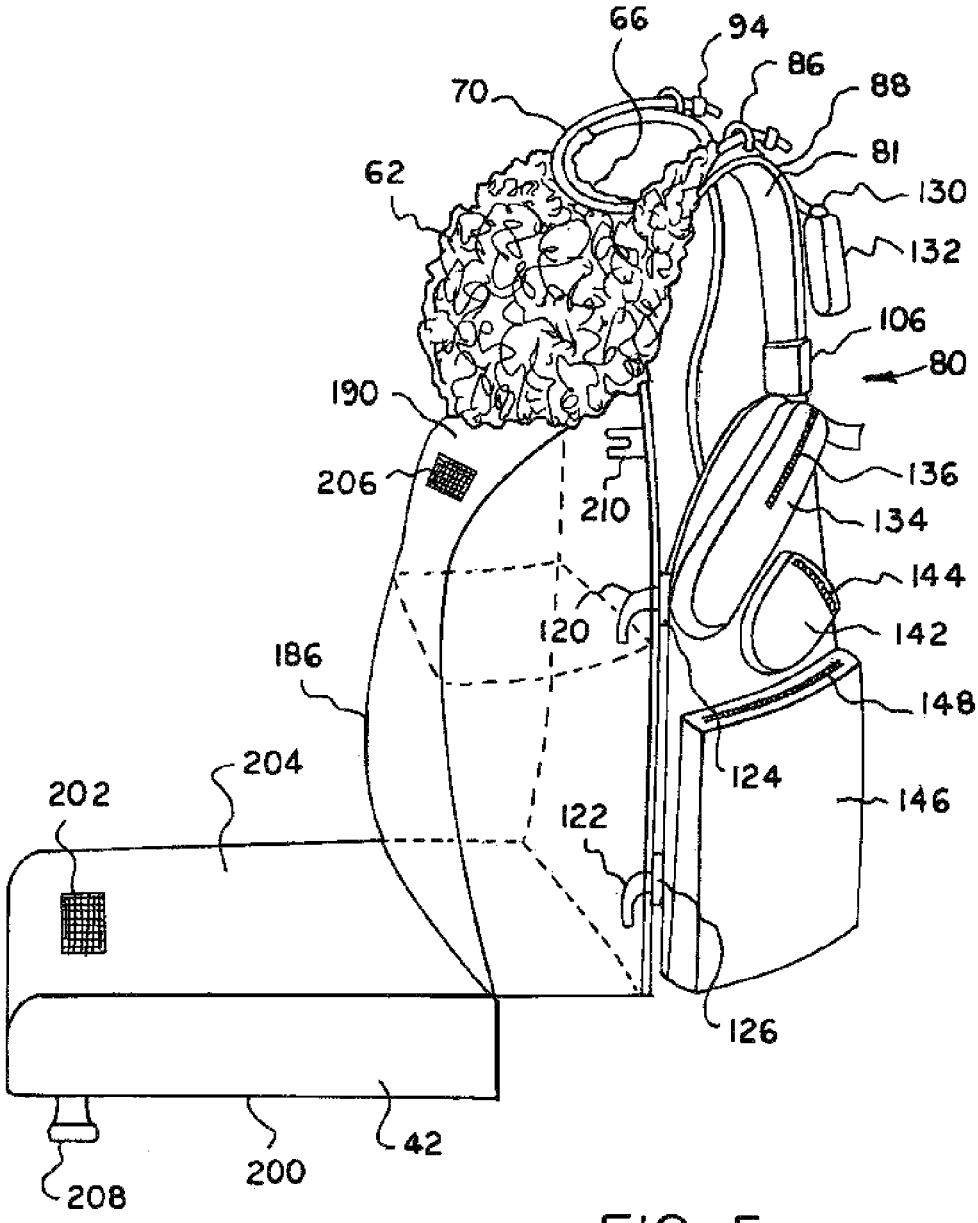
FIGS. 5 to 8 are perspective views of a hunter's vest in combination with a camouflage cape and camouflage hood in accordance with the present invention.
Figure 6:
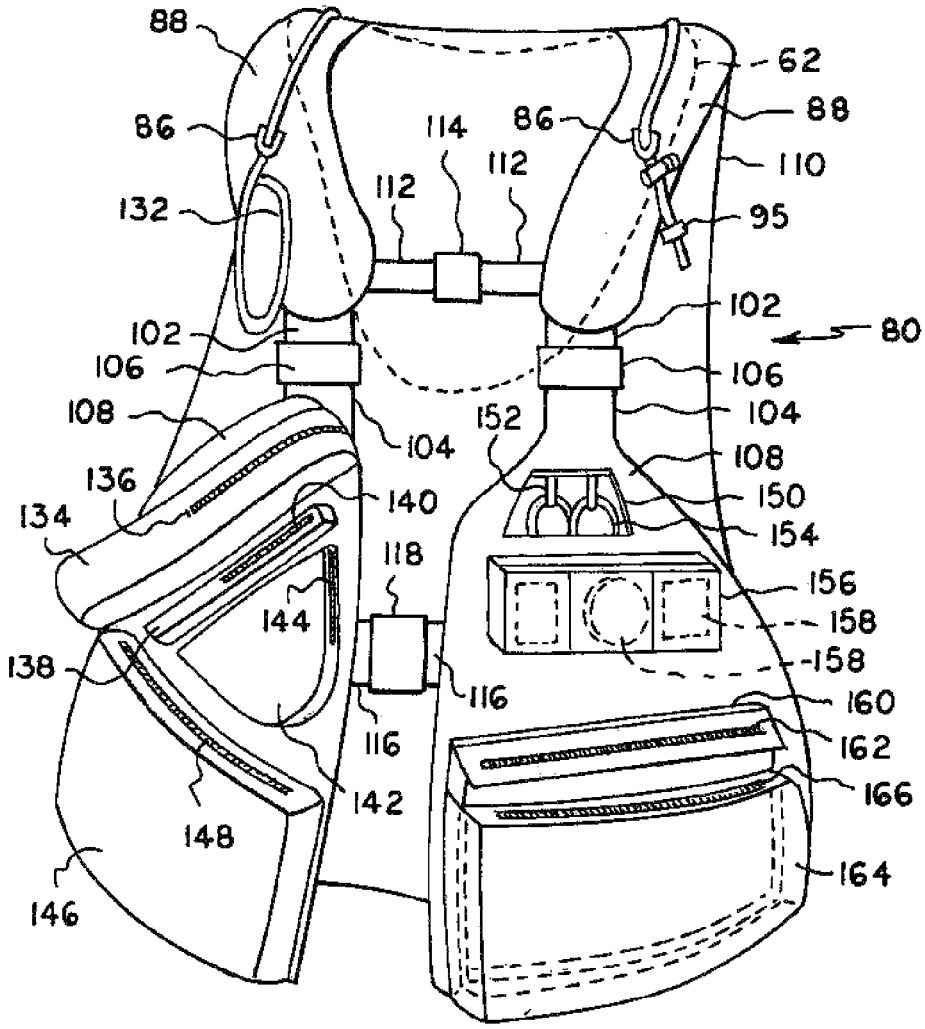
Figure 8:
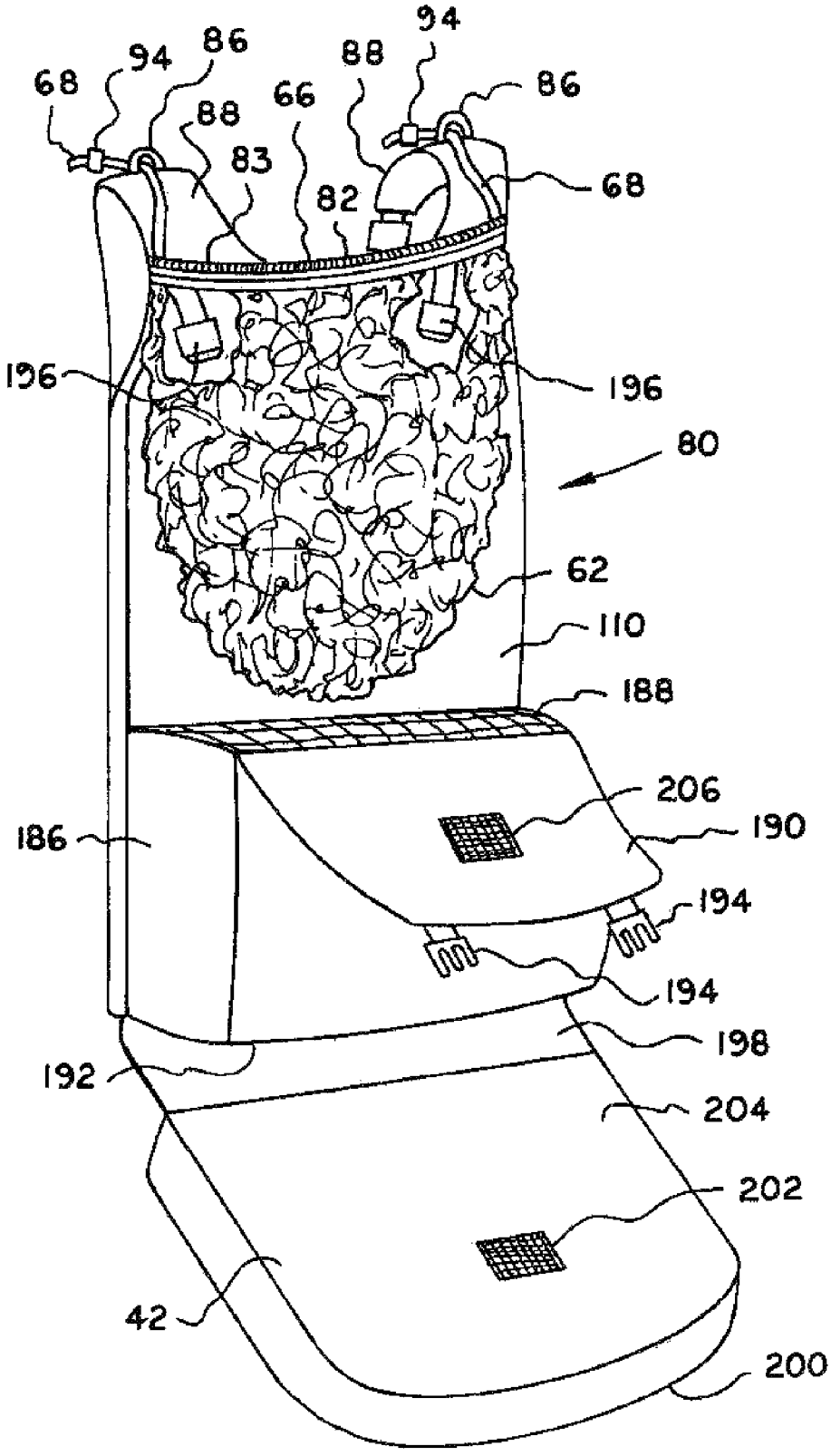

Referring to FIGS. 5 and 8, a collapsible compartment 186 is suitably attached to the lower portion of the backing member 110 to load a turkey or extra gear. It is shown open in FIG. 8 (with upper opening illustrated at 188) for loading a turkey or extra gear and closed in FIG. 5. A flap 190 is sewed or otherwise suitably attached to the upper edge of the compartment outer wall 192. The flap 190 has a couple of buckle portions 194 on its outer edge which engage corresponding buckle portions 196 on the backing member 110 (underneath the pouch 62) to close the compartment 186, as illustrated in FIG. 5.

The seat 42, which may be, for example, a foam waterproof seat, is suitably secured to the vest 80 by a cloth hinge 198 sewed to an upper edge of the seat and to the lower rear edge of the backing member 110 to allow it to be positioned for use as well as for storage as hereafter discussed, without binding and for increased comfort to the hunter while hiking. The hinge 198 can be otherwise suitably attached permanently or to be removable such as, for example, by a zipper, snaps, or straps and buckles. The seat 42 is shown facing rearwardly in FIGS. 5 and 8. With the hinge 198, the seat 42 can be moved to the forward position shown in FIGS. 2 and 7 so that the hunter can sit on it while sitting-in-wait, the upper surface 200 on which the hunter sits shown facing downwardly in FIGS. 5 and 8. With the flap 190 in the closed position shown in FIG. 5, the seat 42 is suitably stowed for hiking by hinged movement allowed by cloth hinge 198 into a vertical position against the compartment 186 and secured in that position by a Velcro strip 202 on its lower surface 204 (near its outer or upper edge) engaging a mating Velcro strip 206 on the flap 190.

Figure 13:
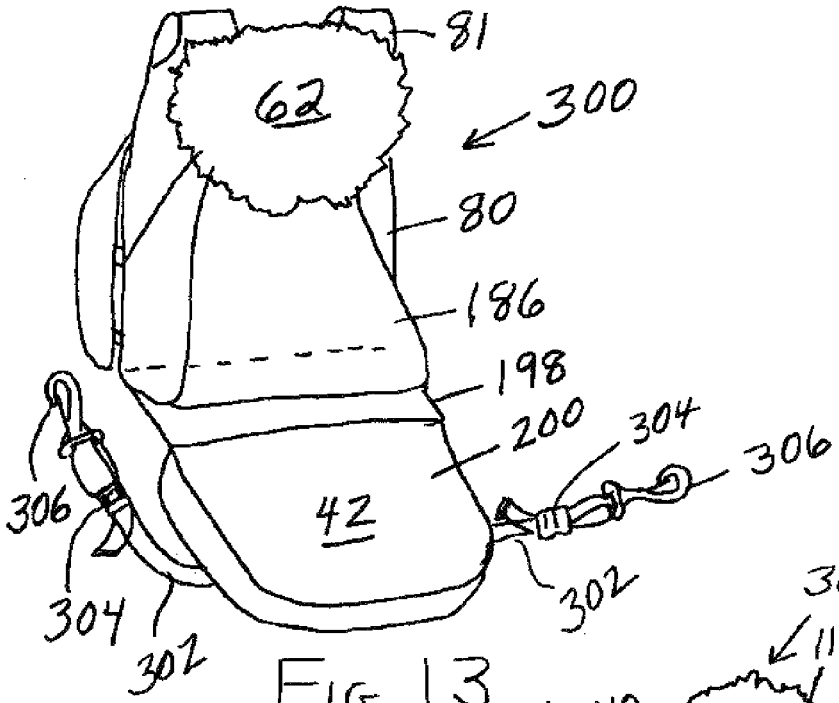
FIG. 13 is a rear perspective view of a hunter's vest in combination with a camouflage hood which contains the cape in accordance with an alternative embodiment of the present invention, showing a seat thereof in position for sitting and illustrating an alternative means for securing the seat to the vest.
Figure 15:
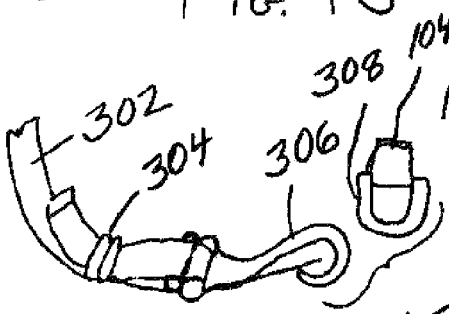
FIG. 15 is a perspective partial detailed view of the alternative means for securing the seat in the position shown in FIG. 14.

Velcro material may not adequately by itself secure the seat 42 in the stowed position. Therefore, in order to adequately secure the seat 42 in the stowed position, it is preferably further secured by buckling means such as, for example, female buckle portions 208 (FIG. 5, not seen in FIGS. 7 and 8) on the laterally outer edges of the seat upper surface 200 (near its outer or upper edge) which engage corresponding male buckle portions 210 on the lateral vertical edges of the backing member 110, with the Velcro material 202 and 206 accordingly being optional. The seat is even more preferably secured by the buckling means described hereinafter with reference to FIGS. 13 to 15.

It should of course be understood that the vest 80 may be differently configured for different purposes. For example, a deer hunter's vest may contain differently shaped storage compartments for calls used for deer hunting. For another example, a soldier's vest may contain compartments shaped for holding various armaments and the like.

Figure 9:
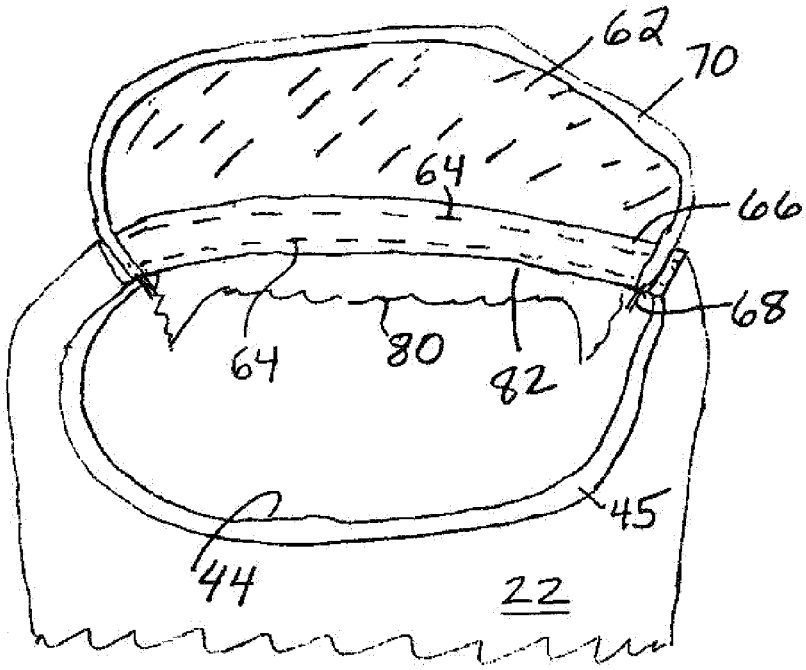
FIG. 9 is a detail view showing the attachment of the camouflage cape and camouflage hood to the hunter's vest.
Figure 12:
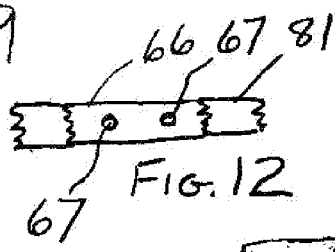
FIG. 12 is a detail view illustrating the attachment of the cape and hood removably to the vest in accordance with an alternative embodiment.
Figure 10:
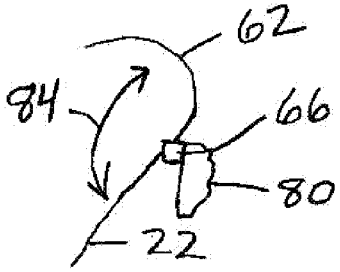
FIG. 10 is a diagrammatic view illustrating how the camouflage cape and camouflage hood are attached to the hunter's vest.

Referring to FIGS. 9 and 10, for attachment of the cape 22 (which is shown in this view to have a hem 45 for the edge of opening 44) and hood 62 to a neck-receiving rear edge 82 of the vest yoke 81, the stiffener strip 66 is sewed to the vest edge 82 as well as to the cape 22 and hood 62. The stiffener strip 66 may have a length of, for example, about 10 inches. In order for the cape 22 and hood 62 to be removable, the stiffener strip 66 may be attached to the vest 80 by, for example, a zipper or snaps 67 (FIG. 12). As best understood from FIG. 10, the stiffener strip 66 may be said to act as an apex for the vest 80, cape 22, and hood 62 whereby the hood 62 may be moved about the apex for placement about the hunter's head and whereby the cape 22 may be pulled out of and pushed into the hood 62 acting as a carrying pouch, as illustrated at 84. The hunter ducks his or her head under and through the opening 44 in the cape 22 as it is pulled out of the pouch 62. When open, the pouch opening may, for example, have a circumference of about 26 to 30 inches.

Figure 11:
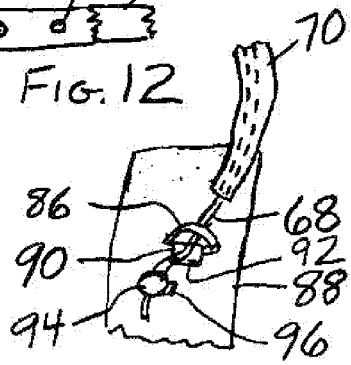
FIG. 11 is a detail view showing the mechanism (one on each side) for opening and closing the camouflage hood.

Referring to FIG. 11, each end portion of the cord 68 is received through an eye member 86 such as, for example, a d-ring, suitably attached to the respective vest shoulder strap 88 by a cloth loop 90 which receives the eye member 86 and which is sewn to the shoulder strap 88 as by stitches 92 or by other suitable means. A spring-loaded cord grabber 94 is received on the cord 68 outwardly of the eye member 86, the eye member 86 being sized sufficiently small to prevent passage of the grabber 94 therethrough. The grabber 94 is conventional and well known in the art and tightly attaches to the cord by means of an internal spring which is biased to urge a button 96 to pinch the cord 68. By pushing the button 96 inwardly against the force of the spring, this pinching effect is removed so that the grabber can be moved along the length of the cord 68. A suitable stop member 95 is attached to the cord 68 near its end to prevent inadvertent removal of the grabber 94 from the cord 68. When the button 96 is released, the spring again urges the button into pinching the cord 68. Thus, when the cord 68 is pulled and cinched up at both ends to close the pouch 62, the buttons 96 are pushed and the grabbers moved inwardly along the cord length then released when near the respective eye members 86 to hold the cinched up position. For opening the pouch 62, the buttons 96 are pushed to allow the hold on the cord 68 to be released and the cord 68 allowed to contract with the grabbers 94 moving outwardly along the length of the cord 68, which allows the pouch 62 to be pulled open so that the cape 22 can be pulled out by finding and pulling on the grip 74. The cape 22 is then pulled over the hunter's head from behind with the head being received in the opening 44 and the cape extending to cover the front of the hunter. The hood 62 may then be pulled onto the head from behind and suitably attached with suitable attachment means. To stow the cape 22, it is removed from around the hunter's neck and, after opening the pouch 62 as hereinbefore discussed, pushed back into the pouch and the pouch closed as hereinbefore discussed.

Figure 14:
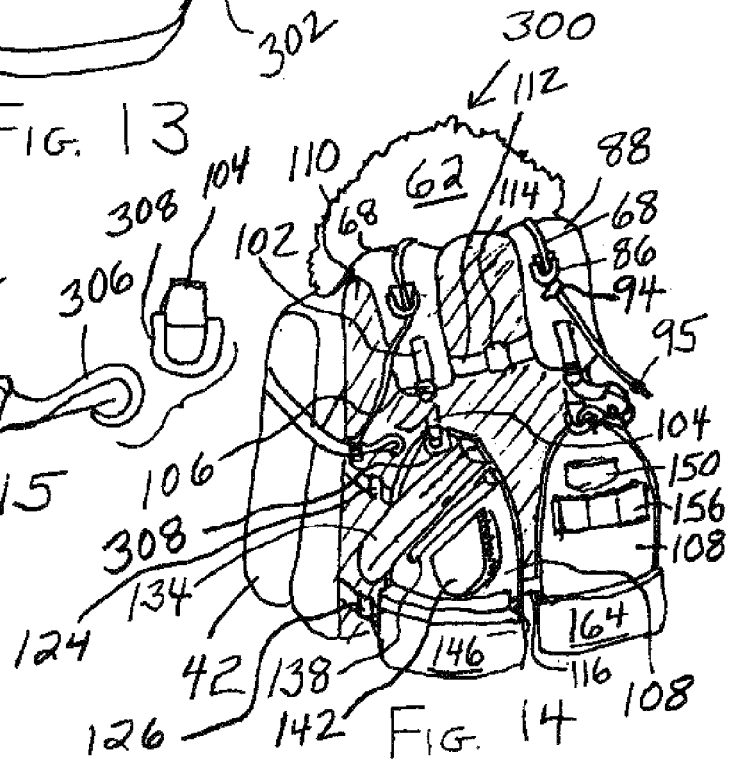
FIG. 14 is a front perspective view of the hunter's vest and hood of FIG. 13, showing the seat attached to the rear thereof.

It has been found that hooking and unhooking the buckles 208 and 210 at the rear of the vest 80 to stow the seat 42 and position the seat 42 for sitting respectively may be difficult. Referring to the alternative embodiment of the vest, shown generally at 300 in FIGS. 13 to 15, in order to make it easier to hook and unhook the seat 42, in accordance with the present invention, a pair of adjustable straps 302 are sewn or otherwise suitably attached to the upper seat surface 200 suitably intermediate the ends thereof, each strap 302 having a suitable conventional length adjusting mechanism 304 and a suitable conventional buckle or clip 306, and each clip 306 is formed to clip to a respective conventional d-ring 308 or other suitable eye member on the respective side of the front of the vest 80, i.e., on the respective vest portion 108, as seen in FIG. 14, or on the respective shoulder strap portion 88. The d-ring 308 is shown to be attached to the strap 104 which is in turn attached such as by sewing to the respective vest portion 108. The straps 302 are adjustable to a sufficient length to extend about the sides respectively of the seat 42 and vest 80 so that the clip 306 can attachably engage the D-ring 308 on the front of the vest 80, so that the clipping and unclipping can more easily be performed by the wearer at the wearer's front.

It should be understood that, while the present invention has been described in detail herein, the invention can be embodied otherwise without departing from the principles thereof, and such other embodiments are meant to come within the scope of the present invention as defined by the appended claims.

What is claimed is:

1. A vest comprising a body portion for engaging a back of a person, a seat which is attached to said body portion to be movable between a use position and a stowed position rearwardly of said body portion, at least one strap attached to said seat, complementary buckle members attached to said at least one strap and to a front portion of said vest to buckle said at least one strap to said vest to hold said seat in said stowed position whereby said buckle members are manipulatable at a location in front of the vest, the vest further comprising a cape composed of camouflage material and attached to said body portion in a manner to allow said cape to be draped about the front of a person wearing the vest and said cape from the neck of the person downwardly in a manner to entirely cover the front of the person when the person is wearing the vest and in a sitting position.

2. A vest comprising a body portion for engaging a back of a person, a seat which is attached to said body portion to be movable between a use position and a stowed position rearwardly of said body portion, at least one strap attached to said seat, complementary buckle members attached to said at least one strap and to a front portion of said vest to buckle said at least one strap to said vest to hold said seat in said stowed position whereby said buckle members are manipulatable at a location in front of the vest, the vest further comprising camouflage apparel including a cape composed of camouflage material attached to the vest.

3. A vest according to claim 2 further comprising a hood composed of camouflage material and attached to the vest and said cape, and said cape and said hood are adapted such that said cape is receivable in said hood for carrying of said cape therein.

4. A vest according to claim 2 further comprising means including a strip of cloth which connects said seat to said body portion thereby serving as a hinge for allowing said seat to be moved between the stowed position rearwardly of said body portion and a use position wherein said seat extends forwardly of said body portion.

5. A vest according to claim 2 wherein said cape has a width between about 4 and 6 feet and a length between about 5 and 7 feet.

6. A vest according to claim 2 wherein said cape has an opening therein which is sized for receiving a head of a person, an upper edge, a lower edge, a width along each of said upper and lower edges which is between about 4 and 6 feet, and a length between about 5 and 7 feet, wherein said opening is disposed intermediate the length of and adjacent said upper edge.

7. A vest according to claim 2 wherein said cape has an opening therein which is sized for receiving a head of a person, an upper edge, a lower edge, a width along each of said upper and lower edges which is between about 4 and 6 feet, and a length between about 5 and 7 feet, wherein said opening is disposed intermediate the length of and adjacent said upper edge, and wherein said opening extends along said upper edge over a distance of about 10 inches and has a circumference between about 26 and 30 inches.

8. A vest according to claim 2 wherein said cape has a pair of first slits therein each sized for receiving a gun and a pair of second slits therein each sized for receiving an arm of the person, wherein said pairs of first and second slits are positioned to enable holding of a gun by either a left-handed person or a right-handed person for shooting thereof while wearing the cape draped over the front of the body of the person.

9. A vest according to claim 2 wherein said cape is composed of netting to which a pattern of leaves are sewed in a manner to provide a three-dimensional effect of leaves fluttering when acted on by a wind.

10. A vest according to claim 2 wherein said cape comprises a sheet which has an opening within the perimeter of said sheet and which is sized for receiving a head of a person and which is disposed adjacent at least a portion of a perimetric edge of said sheet thereby defining a strip of material between said opening and said perimetric edge portion, and wherein said strip of material is attached to the vest in a manner such that said strip of material extends across the back of a neck of the person when the person is wearing the vest and said cape with the person's head received within said sheet opening.

11. A vest according to claim 10 further comprising a stiffening member, a hood composed of camouflage material, and stitches attaching the vest, said cape, and said hood to said stiffening member in a manner such that said stiffening member lies across the back of the neck of the person when the vest is donned and such that said cape is receivable in said hood.

12. A vest according to claim 11 wherein said hood includes a hollow tubular band attached along an edge portion of said hood and having a pair of end portions, a draw cord received in said band and having end portions extending from said band end portions respectively for cinching up said band to close said hood with said cape received therein, and members on said draw cord end portions respectively for releasably grabbing said draw cord to hold said hood closed.

13. A vest comprising a body portion for engaging a back of a person, a seat which is attached to said body portion to be movable between a use position and a stowed position rearwardly of said body portion, at least one strap attached to said seat, complementary buckle members attached to said at least one strap and to a front portion of said vest to buckle said at least one strap to said vest to hold said seat in said stowed position whereby said buckle members are manipulatable at a location in front of the vest, the vest further comprising means including a stiffening member attached to the vest in a manner to lie across the back of the neck of the person when the vest is donned for attaching a hood composed of camouflage material and a cape composed of camouflage material to the vest with the cape receivable in the hood.

14. A vest according to claim 13 further comprising a hood composed of camouflage material, a cape composed of camouflage material, and stitches attaching the vest, said cape, and said hood to said stiffening member.

* * * * *